US008252070B2

(12) United States Patent
Sugita et al.

(10) Patent No.: US 8,252,070 B2
(45) Date of Patent: Aug. 28, 2012

(54) PROCESS AND APPARATUS FOR PRODUCING SOLID FUEL FROM COAL

(75) Inventors: Satoru Sugita, Takasago (JP); Tetsuya Deguchi, Takasago (JP); Takuo Shigehisa, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 533 days.

(21) Appl. No.: 12/064,334

(22) PCT Filed: Nov. 13, 2006

(86) PCT No.: PCT/JP2006/322554

§ 371 (c)(1),
(2), (4) Date: Feb. 21, 2008

(87) PCT Pub. No.: WO2007/060852

PCT Pub. Date: May 31, 2007

(65) Prior Publication Data

US 2009/0255173 A1 Oct. 15, 2009

(30) Foreign Application Priority Data

Nov. 22, 2005 (JP) ..... 2005-337129

(51) Int. Cl.
*C10L 1/32* (2006.01)
*C10L 5/00* (2006.01)
*C10B 1/00* (2006.01)

(52) U.S. Cl. ..... 44/282; 44/629

(58) Field of Classification Search ..... 44/282, 44/626, 280, 281, 500, 501, 502, 503, 504, 44/505, 620, 621, 629, 639
See application file for complete search history.

(56) References Cited

U.S. PATENT DOCUMENTS 3,985,517 A * 10/1976 Johnson ..... 44/501
(Continued)

FOREIGN PATENT DOCUMENTS

DE 689 420 3/1940
(Continued)

OTHER PUBLICATIONS

U.S. Appl. No. 12/517,295, filed Jun. 2, 2009, Sugita, et al.
(Continued)

*Primary Examiner* — Cephia D Toomer
*Assistant Examiner* — Pamela H Weiss
(74) *Attorney, Agent, or Firm* — Oblon, Spivak, McClelland, Maier & Neustadt, L.L.P.

(57) ABSTRACT

The present invention provides a process and an apparatus for producing a low-pyrophoricity, transportable, storable dewatered solid fuel from a low rank coal, in which the amount of heavy oil added can be reduced. A solid fuel production process includes the steps of mixing an oil containing a solvent oil with a coal to prepare a raw material slurry; evaporating moisture from the raw material slurry; subsequently performing solid-liquid separation on the slurry to yield a solid fuel; and adding a heavy oil to the slurry after the completion of or in the course of evaporating moisture. A solid fuel production apparatus includes a mixing vessel 1 in which an oil containing a solvent oil is mixed with a coal to prepare a raw material slurry; evaporators 2 and 3 that evaporate moisture from the raw material slurry; a solid-liquid separation means that perform solid-liquid separation on the slurry from which moisture has been evaporated; and an addition means that adds a heavy oil to the slurry after the completion of or in the course of evaporating moisture.

4 Claims, 6 Drawing Sheets

U.S. PATENT DOCUMENTS

| | | | | |
|---|---|---|---|---|
| 4,396,395 | A * | 8/1983 | Skinner et al. | 44/501 |
| 4,498,905 | A * | 2/1985 | Skinner | 44/602 |
| 4,559,060 | A | 12/1985 | Muroi et al. | |
| 4,624,807 | A | 11/1986 | Miyauchi et al. | |
| 4,671,800 | A | 6/1987 | Meyer et al. | |
| 4,671,801 | A | 6/1987 | Burgess et al. | |
| 4,908,167 | A | 3/1990 | Beckmann et al. | |
| 4,969,928 | A | 11/1990 | Wen et al. | |
| 5,162,050 | A | 11/1992 | Knudson et al. | |
| 5,503,646 | A | 4/1996 | McKenny et al. | |
| 5,554,201 | A | 9/1996 | Yagaki et al. | |
| 5,556,436 | A | 9/1996 | Yagaki et al. | |
| 6,626,966 | B2 | 9/2003 | Shimasaki et al. | |
| 7,413,744 | B2 * | 8/2008 | Ichinohe | 424/401 |
| 7,431,744 | B2 * | 10/2008 | Sugita et al. | 44/282 |
| 7,628,827 | B2 * | 12/2009 | Sugita et al. | 44/629 |
| 2005/0097814 | A1 * | 5/2005 | Sugita et al. | 44/620 |
| 2005/0204615 | A1 | 9/2005 | Sugita et al. | |
| 2007/0062103 | A1 | 3/2007 | Sugita et al. | |

FOREIGN PATENT DOCUMENTS

| | | | |
|---|---|---|---|
| DE | 44 46 401 | C2 | 6/1995 |
| EP | 0 073 788 | B1 | 3/1983 |
| JP | 74045762 | B * | 12/1974 |
| JP | 10-158666 | | 6/1998 |
| JP | 2000-290673 | | 10/2000 |
| JP | 2005-206695 | | 8/2005 |

OTHER PUBLICATIONS

Satoru Sugita, et al., "UBC (Upgraded Brown Coal) Process Development" Kobe Steel Engineering Reports, vol. 53, No. 2, Sep. 2003, pp. 41-45.

* cited by examiner

PROCESS AND APPARATUS FOR PRODUCING SOLID FUEL FROM COAL

TECHNICAL FIELD

The present invention relates to a process and an apparatus for producing a solid fuel from a coal, particularly from a low rank coal.

BACKGROUND ART

Japanese Unexamined Patent Application Publication No. 7-233383 (Patent Document 1) has been disclosed a solid fuel production process for producing a solid fuel from a coal such as a low rank coal. In this process, an oil mixture containing a heavy oil and a solvent oil is mixed with a porous coal, which is equivalent to the low rank coal, to prepare a raw material slurry. The slurry is heated to dewater the porous coal so that the porous coal contains the oil mixture of the heavy oil and the solvent oil in the pores. Then, the slurry is subjected to solid-liquid separation. (The solid fuel production process disclosed in this patent document is hereinafter referred to as known process A.)

Known process A can produce a low-pyrophoricity transportable, storable dewatered solid fuel.

Since porous coal (low rank coal) contains a large proportion of moisture, the transport of the porous coal means that of moisture in a sense, and the transportation cost is relatively increased. Hence, porous coal is inferior in transportability. Also, the amount of calories is reduced by an amount equivalent to the moisture content. Accordingly, it is desired that porous coal be dewatered. Unfortunately, if the dewatering is performed by drying and evaporation using a tubular dryer or the like, oxygen adsorbs to and oxidizes the active points in the pores of the dewatered porous coal. Consequently, an accident by spontaneous combustion can occur undesirably.

Accordingly, known process A evaporates or vaporizes the moisture in the pores of the porous coal by heating the raw material slurry (mixed material containing a porous coal and an oil mixture of a heavy oil and a solvent oil) (thereby dewatering the porous coal), and allows the oil mixture containing the heavy oil to cover the pores. Thus, the oil mixture, particularly preferentially the heavy oil, finally fills the pores. Consequently, oxygen is inhibited from adsorbing to and oxidizing the active points in the pores and, thus preventing the spontaneous combustion. Thus, known process A can produce a low-pyrophoricity, transportable, storable dewatered solid fuel.

The above-cited patent document (Japanese Unexamined Patent Application Publication No. 7-233383) also discloses an apparatus for producing such a solid fuel. The solid fuel production apparatus includes a mixing vessel in which an oil mixture containing a heavy oil and a solvent oil is mixed with a porous coal to prepare a raw material slurry, an evaporator that heats the raw material slurry to remove the vapor, and a solid-liquid separator that performs solid-liquid separation on the heated and thus treated slurry. (The solid fuel production apparatus disclosed in this patent document is hereinafter referred to as known apparatus A.) The porous coal used in the apparatus is equivalent to the low rank coal, as above.

Patent Document 1: Japanese Unexamined Patent Application Publication No. 7-233383

DISCLOSURE OF INVENTION

Problems to be Solved by the Invention

In known process A (solid fuel production process of the above-cited patent document), an oil mixture containing a heavy oil and a solvent oil is mixed with a porous coal to prepare a raw material slurry, and the slurry is heated to dewater the porous coal so that the porous coal contains the oil mixture of the heavy oil and the solvent oil in the pores, followed by solid-liquid separation, as described above. Thus, this process can produce a low-pyrophoricity, transportable, storable dewatered solid fuel; hence, a low-pyrophoricity, transportable, storable dewatered solid fuel can be produced from a porous coal (low rank coal) containing a high proportion of moisture.

However, use of heavy oil increases the solid fuel production cost. It is desired that the heavy oil is reduced.

Accordingly, an object of the present invention is to provide a process and an apparatus for producing a low-pyrophoricity, transportable, storable dewatered solid fuel from a coal, particularly a low rank coal, in which the amount of heavy oil added can be reduced.

Means for Solving the Problems

The inventors of the present invention have conducted intensive research to achieve the object, and have accomplished the invention. The present invention can achieve the object.

The invention thus accomplished and achieving the object relates to a process and an apparatus for producing a solid fuel from a coal, and the process and the apparatus have the following features.

In the solid fuel production process, an oil containing a solvent oil is mixed with a coal to prepare a raw material slurry. Moisture is evaporated from the raw material slurry, and the resulting slurry is subjected to solid-liquid separation to yield a solid fuel. The characteristic feature of this process is that a heavy oil is added to the slurry after the completion of or in the course of the moisture evaporation.

The solid fuel production apparatus includes a mixing vessel in which an oil containing a solvent oil is mixed with a low rank coal to prepare a raw material slurry, an evaporator that evaporates moisture from the raw material slurry, and a solid-liquid separation means that performs solid-liquid separation on the slurry from which moisture has been evaporated. The characteristic feature of this apparatus is that the apparatus has an addition means that adds a heavy oil to the slurry after the completion of or in the course of the moisture evaporation.

The production process and production apparatus of the present invention produce remarkable effects when a low rank coal is used as the coal.

Advantages

According to the solid fuel production process of the present invention, the heavy oil added can be reduced in the production of a low-pyrophoricity, transportable, storable dewatered solid fuel from a coal, particularly a low rank coal.

The solid fuel production apparatus of the present invention can perform the solid fuel production process of the present invention, consequently producing the above effect.

REFERENCE NUMERALS

Figure 1:
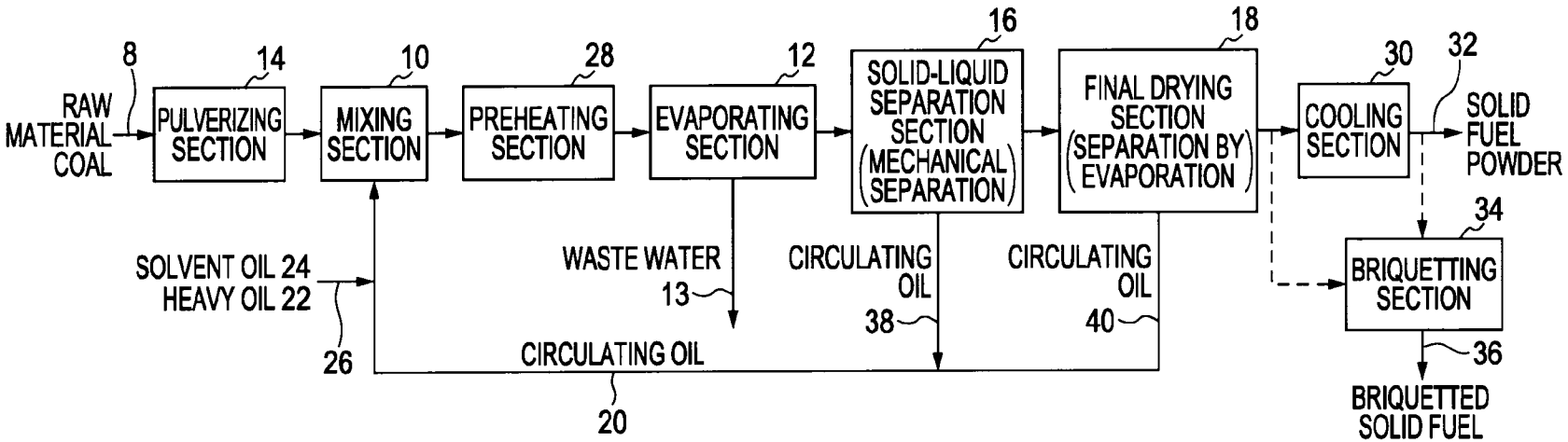
FIG. 1 is a flow diagram of a solid fuel production process according to Comparative Example 1.

1: mixing vessel
2: first evaporator
3: second evaporator
4: third evaporator
8: raw material coal
10: mixing section
11: raw material slurry
12: evaporating section
13: waste water
14: pulverizing section
15: slurry in course of moisture evaporation
16: solid-liquid separation section
17: slurry in course of moisture evaporation
18: final drying section
20: circulating oil
22: heavy oil
24: solvent oil
26: oil mixture
28: preheating section
30: cooling section
32: solid fuel powder
34: briquetting section
36: briquetted solid fuel
38: oil component from solid-liquid separation section
40: oil component from drying section

BEST MODE FOR CARRYING OUT THE INVENTION

The present inventors have conducted intensive research to achieve the object, and found that in a process for producing a solid fuel by evaporating moisture from a raw material slurry and then performing solid-liquid separation on the slurry, a formable, low-pyrophoricity solid fuel (low-pyrophoricity, transportable, storable dewatered solid fuel) can be obtained by adding a heavy oil to the slurry after the completion of or in the course of moisture evaporation, even if the amount of added heavy oil is lower than that in known process A, and that, hence, the heavy oil added can be reduced.

The present invention has been accomplished on the basis of those findings. A solid fuel production process according to the present invention thus accomplished is intended to produce a solid fuel by mixing an oil containing a solvent oil with a coal, for example, a low rank coal, to prepare a raw material slurry, evaporating moisture from the raw material slurry, and then performing solid-liquid separation to yield a solid fuel. The characteristic feature of the solid fuel production process is that a heavy oil is added to the slurry after the completion of or in the course of moisture evaporation. In other words, in a process for producing a solid fuel by solid-liquid separation after evaporating moisture from the raw material slurry, a heavy oil is added to the slurry after the completion of or in the course of the moisture evaporation.

As is clear from the above-described findings, the solid fuel produced by the solid fuel production process of the present invention exhibits a low pyrophoricity and high formability (a low-pyrophoricity, formable dewatered solid fuel can be produced) even if a smaller amount of heavy oil is added than the amount added in known process A. Hence, a smaller amount of heavy oil may be added than the amount added in known process A and, accordingly, the heavy oil added can be reduced. In other words, the heavy oil added can be reduced in a process for producing a low-pyrophoricity, transportable, storable dewatered solid fuel from a low rank coal.

As described above, the solid fuel produced by adding a heavy oil to the slurry after the completion of or in the course of moisture evaporation exhibits a low pyrophoricity and high formability (a low-pyrophoricity, formable dewatered solid fuel can be produced) even if the amount of added heavy oil is lower than that in known process A. This is probably because of the following reasons. The production process and production apparatus of the present invention can be applied to processes using a coal, particularly using a coal as the raw material of a solid fuel. Although the coal used in the process and the apparatus is not particularly limited, a low rank coal (equivalent to porous coal) is particularly advantageously used. The following description will illustrate embodiments of the process and apparatus of the present invention, referring to a low rank coal as an example.

Moisture evaporation allows the low rank coal to be dewatered (moisture in the pores of the low rank coal to be evaporated), and allows the oil containing the solvent oil to penetrate and fill the pores of the low rank coal (porous coal). If a heavy oil is added to the slurry subjected to the moisture evaporation, the heavy oil is added to the slurry in such a state after moisture evaporation.

When a heavy oil is added to such a slurry after the completion of moisture evaporation, the heavy oil is diffused into the pores of the low rank coal in which the solvent oil is present. Accordingly, it takes a long time for the heavy oil to fill the pores of the low rank coal. If the heavy oil is added in a proportion equivalent to that in known process A and if the slurry is allowed to stand for a long time after adding the heavy oil, the heavy oil can fill the pores of the low rank coal. Typically, the slurry is subjected to solid-liquid separation immediately after adding the heavy oil without moisture evaporation, and is not allowed to stand for a long time after the heavy oil has been added. The heavy oil is deposited on the surfaces in the pores and the external surface (surface other than the surfaces in the pores) of the low rank coal and thus covers those surfaces without filling the pores of the low rank coal, or the heavy oil is deposited on the external surface of the low rank coal, and thus covers the surface of the low rank coal and blocks the openings of the pores. This inhibits oxygen from adsorbing to and oxidizing the active points in the pores. Consequently, the resulting solid fuel has a low pyrophoricity. Even if the slurry is allowed to stand for a relatively long time after the heavy oil has been added, the heavy oil is deposited on the external surface of the low rank coal and the surfaces in the pores, and thus covers those surfaces, or thus covers the external surface of the low rank coal and blocks the openings of the pores, as described above, without filling the pores of the low rank coal, as long as the amount of added heavy oil is low (lower than that in known process A). Thus, oxygen is inhibited from adsorbing to and oxidizing the active points in the pores.

In this process, the added heavy oil is preferentially deposited on the external surface of the low rank coal. Accordingly, when the heavy oil is deposited on the surfaces in the pores and the external surface of the low rank coal, the amount of the heavy oil deposited per unit area is larger on the external surface of the low rank coal than on the surfaces in the pores.

Since the heavy oil is thus preferentially deposited on the external surface of the low rank coal, the heavy oil can block the openings of the pores of the low rank coal as well as covering the external surface of the low rank coal. In this instance, a small amount of heavy oil may be brought into contact with the surfaces in the pores, but a much larger amount of the heavy oil per unit area is deposited on the external surface of the low rank coal. Thus, the amount of heavy oil deposited on the external surface of the low rank coal is equal to or more than that in known process A even if a smaller amount of heavy oil is added than the amount added in known process A. Consequently, the resulting solid fuel is highly formable.

Thus, a low-pyrophoricity, formable solid fuel (low-pyrophoricity, formable dewatered solid fuel) can be produced by adding a heavy oil to the slurry after moisture evaporation, even if the amount of added heavy oil is smaller than that in known process A.

In the addition of a heavy oil to the slurry in the course of moisture evaporation, the low rank coal in the slurry is dewatered to some extent (moisture in the pores of the low rank coal is vaporized or evaporated to some extent) by moisture evaporation until the heavy oil is added, and the oil containing the solvent oil penetrates and fills the pores of the low rank coal (porous coal). The heavy oil is added to the slurry in such a state in the course of moisture evaporation.

When a heavy oil is added to such a slurry in the course of moisture evaporation, the heavy oil can fill the pores of the porous coal if a amount of heavy oil as large as that in known process A is added and if the slurry is allowed to stand for a long time after a moisture evaporation treatment subsequent to the addition of the heavy oil. In general, however, moisture evaporation is performed in a short time (in a shorter time than the moisture evaporation in known process A) after the addition of the heavy oil, and solid-liquid separation is performed after the moisture evaporation. Thus, it is not normal to allow the slurry to stand for a long time after the addition of the heavy oil (the time interval between the addition of the heavy oil and the solid-liquid separation is short). Accordingly, the heavy oil is deposited on the external surface of the low rank coal and the surfaces in the pores and thus covers those surfaces, or thus covers the external surface of the low rank coal and blocks the openings of the pores, without filling the pores of the low rank coal. Thus, oxygen is inhibited from adsorbing to and oxidizing the active points in the pores. Consequently, the resulting solid fuel has a low pyrophoricity.

In this process, the added heavy oil is preferentially deposited on the external surface of the low rank coal. Accordingly, the amount per unit area of the heavy oil deposited on the external surface of the low rank coal can be equal to or more than that in known process A even if the amount of added heavy oil is smaller than that in known process A, because of the same reason as in the case in which the heavy oil is added to the slurry after the completion of moisture evaporation. Consequently, the resulting solid fuel is highly formable.

Thus, a low-pyrophoricity, formable solid fuel (low-pyrophoricity, formable dewatered solid fuel) can be produced by adding a heavy oil to the slurry in the course of moisture evaporation, even if the amount of added heavy oil is smaller than that in known process A.

When a heavy oil is added to the slurry in the course of moisture evaporation, however, the slurry is further subjected to moisture evaporation after the addition of the heavy oil. Accordingly, the heavy oil is deposited on the surfaces in the pores and the external surface of the low rank coal rather than it is deposited on the external surface of the low rank coal and blocks the openings of the pores.

In this process in which the heavy oil is deposited on the surfaces in the pores and the external surface of the low rank coal, as well, the heavy oil is preferentially deposited on the external surface of the low rank coal. Accordingly, the amount of heavy oil deposited per unit area is larger on the external surface of the low rank coal than on the surfaces in the pores of the low rank coal. However, moisture evaporation is continued after the addition of the heavy oil and, consequently, the possibility that the heavy oil enters the pores of the low rank coal is high. More specifically, the heavy oil can permeate the pores during moisture evaporation after the addition of the heavy oil. Thus, the amount of heavy oil permeating the pores of the low rank coal is larger than the case in which the heavy oil is added to the slurry after the completion of moisture evaporation, and consequently the difference between the amounts of the heavy oil deposited on the external surface and the surfaces in the pores of the low rank coal is reduced. In order to control the amount of the heavy oil deposited on the external surface of the low rank coal (that is, the formability) so as to be equal to that in a case in which the heavy oil is added to the slurry after the completion of moisture evaporation, the amount of the heavy oil deposited on the surfaces in the pores is increased in comparison with the case in which the heavy oil is added to the slurry after the completion of moisture evaporation. Consequently, the amount of heavy oil required is increased in comparison with the case where the heavy oil is added to the slurry after the completion of moisture evaporation.

As moisture evaporation before adding a heavy oil is performed for a longer time than moisture evaporation after the addition of the heavy oil, the difference between the amount of heavy oil deposited on the external surface of the low rank coal and the amount of heavy oil deposited on the surfaces in the pores is increased and, thus, the amount of the heavy oil required is reduced to an amount close to that required when the heavy oil is added to the slurry after the completion of moisture evaporation. Accordingly, it is preferable that the moisture evaporation before adding a heavy oil be performed for a longer time than the moisture evaporation after the addition of the heavy oil. In other words, it is preferable that the heavy oil be added at a point during moisture evaporation as close as possible to the end point of the moisture evaporation, or added to the slurry in a state as close as possible to the state in which the moisture evaporation is completed.

In known process A, moisture in the pores of the low rank coal in a raw material slurry (a mixed material containing a porous coal and an oil mixture of a heavy oil and a solvent oil) is evaporated or vaporized by heating the raw material slurry, so that the oil mixture fills the pores of the low rank coal and the surfaces in the pores are coated with the heavy oil, as described above. Consequently, oxygen is inhibited from adsorbing to and oxidizing the active points in the pores, and thus spontaneous combustion is prevented. Thus, a low-pyrophoricity, transportable, storable dewatered solid fuel can be produced. In this instance, the heavy oil is also deposited on the external surface of the low rank coal, thus ensuring high formability. Hence, known process A can produce a low-pyrophoricity, transportable, storable, formable dewatered solid fuel.

If the heavy oil content in the oil mixture mixed with the low rank coal is reduced, that is, if the amount of heavy oil added is reduced, the amount of heavy oil deposited on the external surface of the low rank coal is reduced, and consequently the resulting solid fuel has a low, or insufficient formability, even if oxygen is inhibited from adsorbing to and oxidizing the active points in the pores.

In the solid fuel production process of the present invention, a heavy oil is added to the slurry after the completion of (or in the course of) moisture evaporation from a raw material slurry, and the added heavy oil is preferentially deposited on the external surface of the low rank coal. On the other hand, in known process A, the raw material slurry (mixed material containing a porous coal and an oil mixture of a heavy oil and a solvent oil), which contains the heavy oil in advance, is subjected to moisture evaporation, and the oil mixture containing the heavy oil permeates the pores of the low rank coal simultaneously with or after the evaporation of moisture from the pores of the low rank coal. Probably, the heavy oil is thus substantially evenly deposited on the external surface of the low rank coal and the surfaces in the pores. Accordingly, if the amount of heavy oil added in known process A is reduced to a level as low as that in the solid fuel production process of the present invention, the amount of heavy oil deposited on the external surface of the low rank coal is reduced in comparison with the case in which the solid fuel production process is applied, and the resulting solid fuel exhibits a low, or insufficient, formability, even if the heavy oil is deposited on the surfaces in the pores of the low rank coal to inhibit oxygen from adsorbing to and oxidizing the active points in the pores. If the amount of heavy oil added in known process A is reduced so that the amount of heavy oil deposited on the surfaces in the pores of the low rank coal is controlled to substantially the same level as that in the solid fuel production process of the present invention, oxygen can be inhibited from adsorbing to or oxidizing the active points in the pores, but the amount of heavy oil deposited on the external surface of the low rank coal is reduced to a level lower than that in the solid fuel production process of the present invention. Consequently, the resulting solid fuel exhibits a low, or insufficient, formability. As described above, if the heavy oil content is reduced in known process A, the amount of heavy oil deposited on the external surface of the low rank coal is reduce. Consequently, the resulting solid fuel exhibits a low, or insufficient, formability.

Even if the heavy oil content is reduced in known process A, oxygen can be inhibited from adsorbing to and oxidizing the active points in the pores of the low rank coal as long as the heavy oil is sufficiently deposited on the surfaces in the pores. This, however, makes it difficult to ensure a sufficient formability. Only when the heavy oil is added in such an amount as the heavy oil inhibiting oxygen from adsorbing to and oxidizing the active points in the pores of the low rank coal can fill the pores, the heavy oil is sufficiently deposited on the external surface of the low rank coal, consequently ensuring a high formability. In other words, in order to ensure a high formability, such an amount of heavy oil as can fill the pores of the low rank coal must be added (such an amount of heavy oil is hereinafter referred to as heavy oil amount A). The addition of such an amount of heavy oil is excessive in view of inhibiting oxygen from adsorbing to and oxidizing the active points in the pores (the excess heavy oil is hereinafter referred to as excess X).

In the solid fuel production process of the present invention, on the other hand, the added heavy oil is preferentially deposited on the external surface of the low rank coal. Consequently, oxygen is inhibited from adsorbing to and oxidizing the active points in the pores and, thus, a high formability is ensured even if a small amount of heavy oil is added. The amount of added heavy oil may not be so large as to fill the pores of the low rank coal, and can be smaller. For example, it can be an amount obtained by subtracting the excess X from the heavy oil amount A (A−X=B). Hence, the amount of heavy oil added is reduced to the amount B (=A−X) by the excess X.

If a method (hereinafter referred to as method C) is applied in which the liquid component (containing oil components (solvent oil and heavy oil)) separated by the solid-liquid separation after moisture evaporation is circulated as a circulating oil to a section preparing the raw material slurry and mixed with the low rank coal (porous coal), the circulating oil permeates the pores of the low rank coal during moisture evaporation and the heavy oil in the circulating oil is deposited on the surfaces in the pores of the low rank coal. The heavy oil content in the circulating oil is however low, and the amount of heavy oil deposited is small and is not sufficient at all to inhibit oxygen from adsorbing to and oxidizing the active points in the pores (and consequently to prevent spontaneous combustion). Although, in this process, the heavy oil is also deposited on the external surface of the low rank coal, the amount deposited is small and is not sufficient at all to ensure a high formability. Accordingly, method C requires an additional amount of heavy oil. In known process A, such heavy oil is added to the section preparing the raw material slurry and mixed with the low rank coal. In the solid fuel production process of the present invention, on the other hand, the heavy oil is added to the slurry after the completion of (or in the course of) moisture evaporating from the raw material slurry. In this instance, a smaller amount of heavy oil is added in the solid fuel production process of the present invention than in known process A. Thus, the process of the present invention can reduce the amount of heavy oil added. The solid fuel production process of the present invention can inhibit oxygen from adsorbing to and oxidizing the active points in the pores and ensure a high formability even if a smaller amount of heavy oil is added than the amount added in known process A. Preferably, a mixture of a heavy oil and a solvent oil, rather than only the heavy oil, is added in the step of adding the heavy oil, from the viewpoint of fluidity and easy diffusion.

The solid fuel production process of the present invention allows a smaller amount of heavy oil than known process A to be added; hence, the heavy oil added is reduced and, consequently, the oil component can be easily and efficiently removed by solid-liquid separation after moisture evaporation because of such a small amount of heavy oil. More specifically, in a process for producing a solid fuel by solid-liquid separation after moisture evaporation, the slurry from which moisture has been evaporated is generally subjected to solid-liquid separation with a mechanical solid-liquid separator, such as a centrifuge. The thus separated solid component is dried (and from which the oil component is evaporated) with a dryer or the like to yield a solid fuel. Since the heavy oil content in the solid component is low, the solid component can be easily and efficiently dried (and from which the oil component can be easily and efficiently evaporated).

The solid fuel production apparatus of the present invention includes a mixing vessel in which an oil containing a solvent oil is mixed with a low rank coal to prepare a raw material slurry; an evaporator that evaporates moisture from the raw material slurry; a solid-liquid separation means that performs solid-liquid separation on the slurry subjected to the moisture evaporation to yield a solid fuel. The solid fuel production apparatus further includes an addition means that adds a heavy oil to the slurry after the completion of or in the course of the moisture evaporation.

The solid fuel production apparatus of the present invention can perform the above-described solid fuel production process of the present invention, and can consequently produce the same effects as the solid fuel production process of the present invention. More specifically, the mixing vessel, the evaporator, and the solid-liquid separation means perform the steps in the solid fuel production process of preparing a raw material slurry, evaporating moisture from the raw material slurry, and performing solid-liquid separation, and the addition means adds a heavy oil to the slurry after the completion of or in the course of the moisture evaporation. Thus, the apparatus can perform the above-described solid fuel production process of the present invention, and can consequently produce the same effects as the solid fuel production process of the present invention.

The slurry in the course of moisture evaporation used herein refers to the slurry in an intermediate stage of the moisture evaporation, that is, the slurry in a state between the start point of the moisture evaporation from the raw material slurry and the end pint of the moisture evaporation (slurry between the start point and the end point of the moisture evaporation). The slurry in this state is not necessarily in a state from which moisture has been intermediately evaporated, and may be in any state between the start point and the end point of the moisture evaporation. The slurry in the course of moisture evaporation may be in a state from which moisture has been intermediately or slightly evaporated or in a state immediately before completion of the moisture evaporation.

The moisture evaporation from the raw material slurry is generally performed in evaporators (dewatering vessels) provided in each stage. For example, the moisture evaporation may be performed twice in evaporators provided in two stages, or three times in evaporators provided in three stages. In the former case, a first evaporator (dewatering vessel) in the first stage evaporates moisture from the raw material slurry, and a second evaporator in the second stage further evaporates moisture from the slurry after the moisture evaporation in the first stage. In the latter case, a first evaporator in the first stage evaporates moisture from the raw material slurry, a second evaporator in the second stage evaporates moisture from the slurry after the moisture evaporation in the first stage, and further a third evaporator in the third stage evaporates moisture from the slurry after the moisture evaporation in the second stage.

In the former (two-stage) case, a heavy oil is added to the slurry from which moisture has been evaporated in the first evaporator. In the latter (three-stage) case, the heavy oil is added to the slurry from which moisture has been evaporated in the first or the second evaporator. In either case, the heavy oil is added in the slurry in the course of moisture evaporation.

If the heavy oil is added to the slurry in a state in which moisture evaporation has not progressed much, the heavy oil can be reduced by only a small amount. In contrast, the heavy oil can be reduced by a large amount and the amount of heavy oil required can thus be reduced by addition the heavy oil to the slurry in a state in which moisture evaporation has progressed much. It is therefore preferable that a heavy oil be added to the slurry in a state in which moisture evaporation has progressed much, for example, in a state close to the completion of moisture evaporation. For example, if the moisture evaporation is performed three times in the three evaporators provided in the three stages, the heavy oil is preferably added to the slurry after being subjected to moisture evaporation in the second evaporator. The heavy oil may of course be added to the slurry after the completion of moisture evaporation, that is, to the slurry after being subjected to moisture evaporation in the third evaporator. This is, in general, preferable. If the moisture evaporation is performed twice, the heavy oil may be added to the slurry after being subjected to moisture evaporation in the second evaporator, and this is generally preferable.

The low rank coal used herein refers to a coal containing a large proportion, generally 20% or more, of moisture and needing to be dewatered, as described above. Examples of the low rank coal include lignite or brown coal, and subbituminous coal. Examples of lignite include Victoria coal, North Dakota coal, and Beluga coal. Examples of subbituminous coal include West Banko coal, Binungan coal, and Samarangau coal. The low rank coal is not limited to those coals, and any coal containing moisture and needing to be dewatered may be used as the low rank coal in the present invention.

The heavy oil used herein refers to that capable of covering the external surface of the low rank coal and the surfaces in its pores and blocking the contact of external air, particularly oxygen, with the active points in the pores. Examples of the heavy oil include petroleum heavy oil, unrefined petroleum light oil fraction containing heavy oil, kerosene fraction, lubricating oil components, coal tar, light oil or kerosene containing impurities from heavy oil because of being used as a solvent or a cleaner, and thermal oil containing a degraded fraction because of repetitive use. A preferred heavy oil may be a heavy oil substantially not having a vapor pressure even at 400° C., such as vacuum oil residue, or an oil containing such a heavy oil. The solvent oil used herein has a high affinity for the heavy oil, makes the slurry easy to handle, and can easily permeate the pores. Examples of the solvent oil include kerosene, light oil and heavy oil (petroleum oil having a boiling of 100° C. or more, preferably 300° C. or less on average). The "oil containing a solvent oil" used herein is intended to be mixed with a coal for preparing the raw material slurry, and may be composed of only a solvent oil or may contain a solvent oil and another oil component, such as a heavy oil, generally a small amount of heavy oil.

The moisture evaporation from the raw material slurry dewaters the low rank coal contained in the raw material slurry. In other words, the moisture contained in the low rank coal is evaporated, and thus the vapor generated by the evaporation is removed.

The mixing vessel is not particularly limited, and various types of mixing vessel may be used. For example, an axial-flow agitator is typically used.

The evaporator is not particularly limited, and various types of evaporator may be used, including a heating type, a vacuum type, and a vacuum heating type. For example, the evaporator may be a flash evaporation type, a coil type, a forced circulation vertical tube type. For example, a forced circulation evaporator including a heat exchanger is typically used.

The addition means that adds a heavy oil to the slurry after the completion of or in the course of moisture evaporation is not particularly limited and various types of addition means may be used. For example, the addition means may feed the heavy oil to a mixing section in which the slurry after the completion of or in the course of moisture evaporation is mixed with the heavy oil. If the moisture evaporation is performed twice in two evaporators, the mixing section is disposed between the second evaporator and the solid-liquid separator and/or between the first evaporator and the second evaporator.

For producing a solid fuel through moisture evaporation and subsequent solid-liquid separation, typically, the slurry after moisture evaporation is subjected to solid-liquid separation with a mechanical solid-liquid separator and the separated solid component is dried (and from which the oil component is evaporated) with a dryer or the like to yield a solid fuel, as described above. The mechanical solid-liquid separator is not particularly limited and various types of separator may be used, including a centrifuge, a compressor, a sedimentation vessel, and a filter. For example, a centrifuge is typically used.

EXAMPLES

The present invention will described more specifically with reference to Examples and Comparative Examples. The present invention is not limited to those Examples and various modifications may be appropriately made without departing from the spirit and scope of the invention. The art of the present invention includes such modifications.

Comparative Example 1

Figure 4:
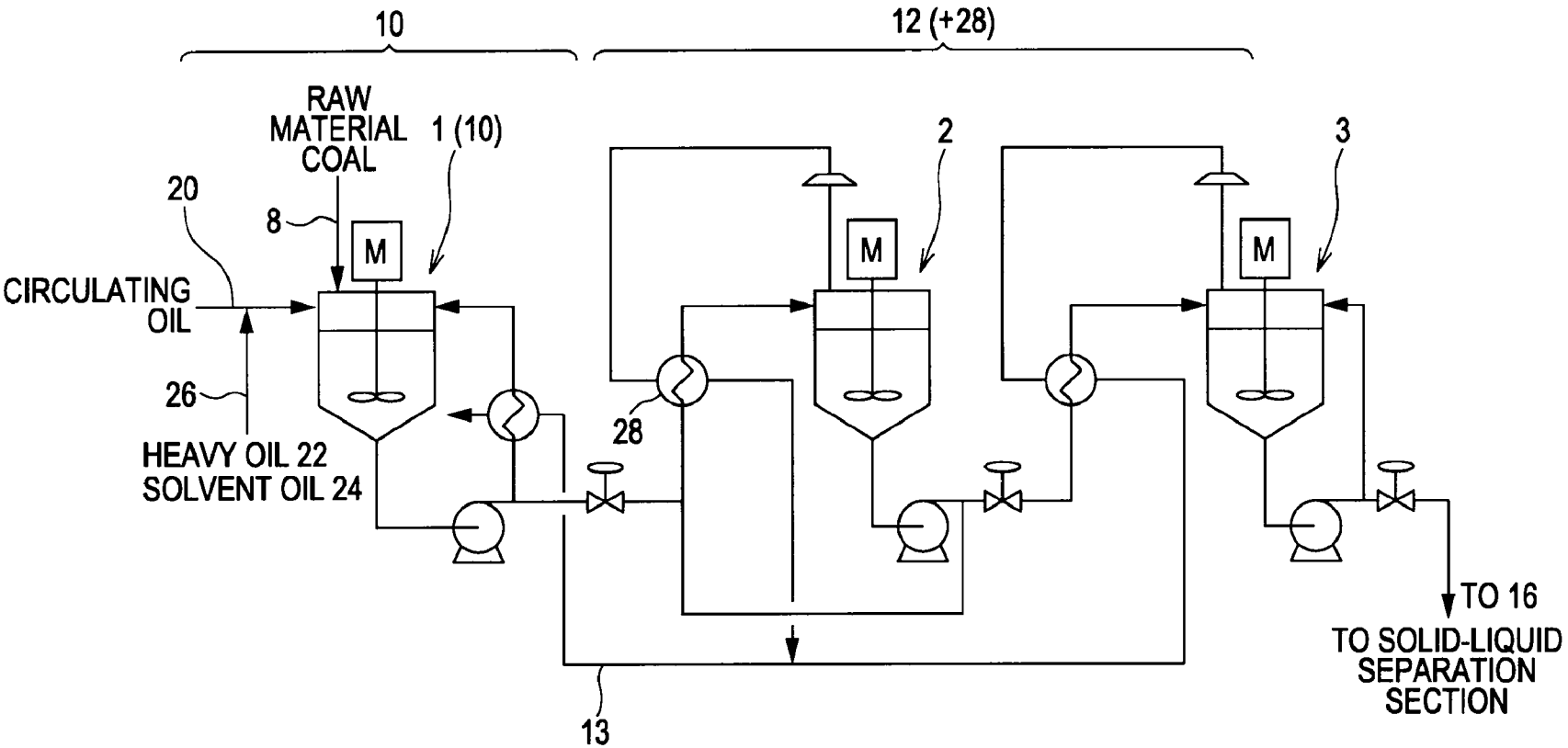
FIG. 4 is a schematic representation of a mixing section and an evaporating section in the solid fuel production process of Comparative Example 1.

A flow diagram of the solid fuel production process of Comparative Example 1 is shown in FIG. 1. FIG. 4 shows the raw material slurry preparation section (mixing section 10) and the moisture evaporation section (evaporating section 12) of this production process in detail (including a preheating section 28).

AS shown in FIGS. 1 and 4, a low rank coal 8 (porous coal) was pulverized as the raw material coal in a pulverizing section 14 and fed into the raw material slurry preparation section (mixing section 10), or the mixing vessel 1. The raw material coal was mixed with an oil mixture 26 containing a heavy oil and a solvent oil in the mixing vessel 1 to prepare a raw material slurry. The raw material coal 8 shown in FIG. 4 has been already pulverized in the pulverizing section 14. The low rank coal used as the raw material was Indonesia Samarangau coal containing 35% by mass (by weight) of moisture. As the oil mixture containing a heavy oil and a solvent oil, which was to be mixed with the low rank coal, an oil mixture prepared by mixing asphalt with kerosene was used at the beginning of the operation, and another oil mixture was used in the subsequent stages. This oil mixture was prepared by adding a heavy oil (asphalt) 22 and a solvent oil (kerosene) 24 to a circulating oil 20, which was the oil component discharged from a solid-liquid separation section 16 (mechanical separation) and a final drying section 18 (separation by evaporation) and was circulated to the mixing vessel 1 (or mixing section 10) as described above. The kerosene belongs to the solvent oil, and the asphalt belongs to the heavy oil. The asphalt content in the oil mixture was set at 0.5% by weight (mass %). An amount of heavy oil is added by feeding the oil mixture 26 to the mixing vessel 1 (the oil mixture was added actually), and the amount of heavy oil added was set so that 0.5% by mass of heavy oil would be deposited in the solid fuel (which was obtained in the final drying section 18 (dryer) by evaporating the oil component from the cake prepared in the solid-liquid separation section 16) relative to the dried low rank coal (reformed coal) in the solid fuel.

The raw material slurry was preheated in the preheating section 28, and then moisture was evaporated and removed as waste water 13 from the slurry in the evaporating section 12 (a first evaporator 2 and a second evaporator 3). More specifically, the first evaporator 2 evaporated moisture from the raw material slurry, and the second evaporator 3 evaporated the slurry after the moisture evaporation in the second evaporator. The evaporators were of forced circulation type including a heat exchanger, and were heated to 160° C.

The moisture-evaporated slurry was delivered to the solid-liquid separation section (mechanical separation) 16 and was subjected to solid-liquid separation in a centrifuge. The solid component (cake) prepared by this separation was delivered to the final drying section (separation by evaporation) 18 and was heated to evaporate the oil component with a dryer while a carrier gas was flowing. Thus, a solid fuel was produced. The solid fuel may be delivered to a cooling section 30 from the dryer and cooled there. The cooled solid fuel may be used as solid fuel powder 32, or formed into a briquetted solid fuel 36 in a briquetting section 34. Alternatively, the solid fuel may directly be delivered to the briquetting section 34 and formed into a briquetted solid fuel 36 without being delivered to the cooling section.

The liquid component (oil component 38) separated in the centrifuge was circulated as a circulating oil 20 to the mixing vessel 1. The oil component evaporated with the dryer (evaporated oil component) was carried with a carrier gas to a dust chamber from the dryer and further carried to a cooler (gas cooler). The evaporated oil component was liquefied in the cooler. The liquefied oil component 40 was partially circulated as the circulating oil 20 to the mixing vessel 1. The circulating oil 20 was used as part of the oil for preparing the raw material slurry. More specifically, a heavy oil (asphalt) 22 and a solvent oil (kerosene) 24 were added to the circulating oil 20, and then the circulating oil was fed into the mixing vessel 1. In this instance, the heavy oil (asphalt) was added in such an amount as the heavy oil content in the oil (oil mixture) prepared by adding the heavy oil and the solvent oil to the circulating oil would be 0.5% by mass. At this point, an amount of heavy oil was added by feeding the oil mixture to the mixing vessel 1 (though the oil mixture was added actually), and the amount of added heavy oil was set so that 0.5% by mass of heavy oil would be deposited in the solid fuel (obtained by evaporating the oil component with a dryer from the cake prepared by solid-liquid separation) relative to the dried low rank coal (reformed coal) in the solid fuel.

The solid fuel production process described above was continuously performed, consequently producing a low-pyrophoricity, transportable, storable dewatered solid fuel. The amount of heavy oil deposited in this solid fuel (obtained in the final drying section 18 (dryer) by evaporating the oil component from the cake prepared in the solid-liquid separation section 16) was 0.5% by mass relative to the dried low rank coal (reformed coal) in the solid fuel.

Comparative Example 2

An oil mixture (containing a heavy oil (asphalt) and a solvent oil (kerosene)) was fed into the mixing vessel 1 at the beginning of the operation, and the amount of heavy oil added by feeding the oil mixture into the mixing vessel 1 (the oil mixture was added actually, though) was set at 60% of that in Comparative Example 1. In the subsequent stages, the circulating oil to which a heavy oil (asphalt) and a solvent oil (kerosene) had been added (oil mixture) was fed into the mixing vessel 1, and the amount of heavy oil added by feeding the oil mixture into the mixing vessel 1 (the oil mixture was added actually, though) was set at 60% of that in Comparative Example 1. The solid fuel production process was continuously performed in the same manner as in Comparative Example 1 except for those points.

Consequently, the resulting solid fuel was dewatered and exhibited a low pyrophoricity and a high transportability and storability. However, the formability of the solid fuel was low and insufficient. The amount of heavy oil deposited in the solid fuel (obtained in the final drying section 18 (dryer) by evaporating the oil component from the cake prepared in the solid-liquid separation section 18) was 0.3% by mass relative to the dried low rank coal (reformed coal) in the solid fuel.

Example 1

Figure 2:
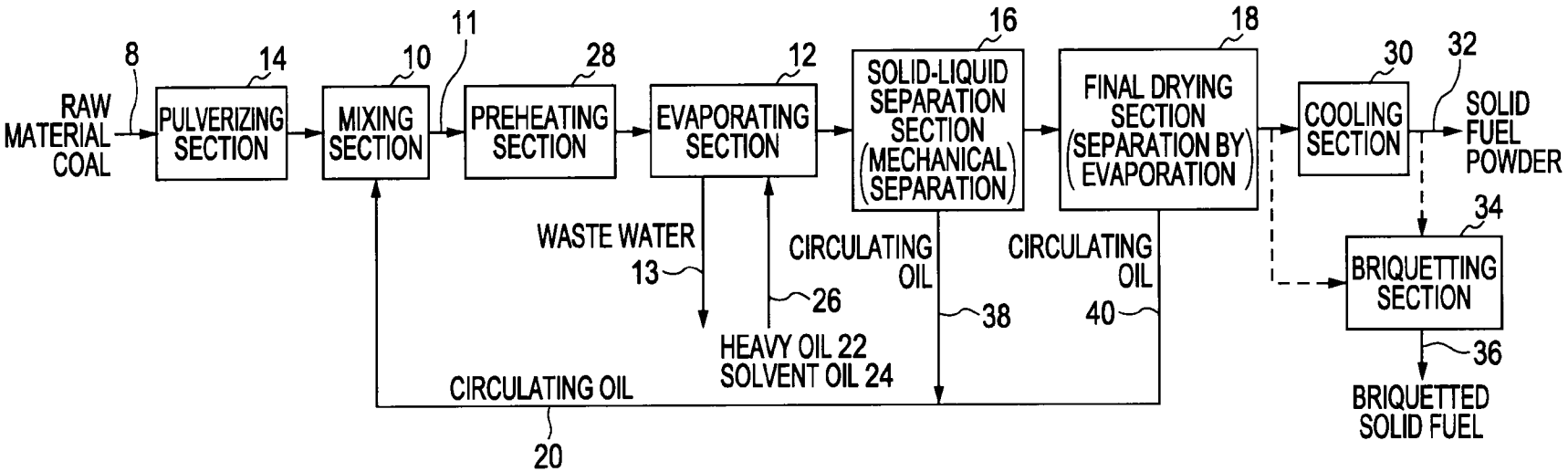
FIG. 2 is a flow diagram of a solid fuel production process according to an embodiment and Example 1 of the present invention.
Figure 5:
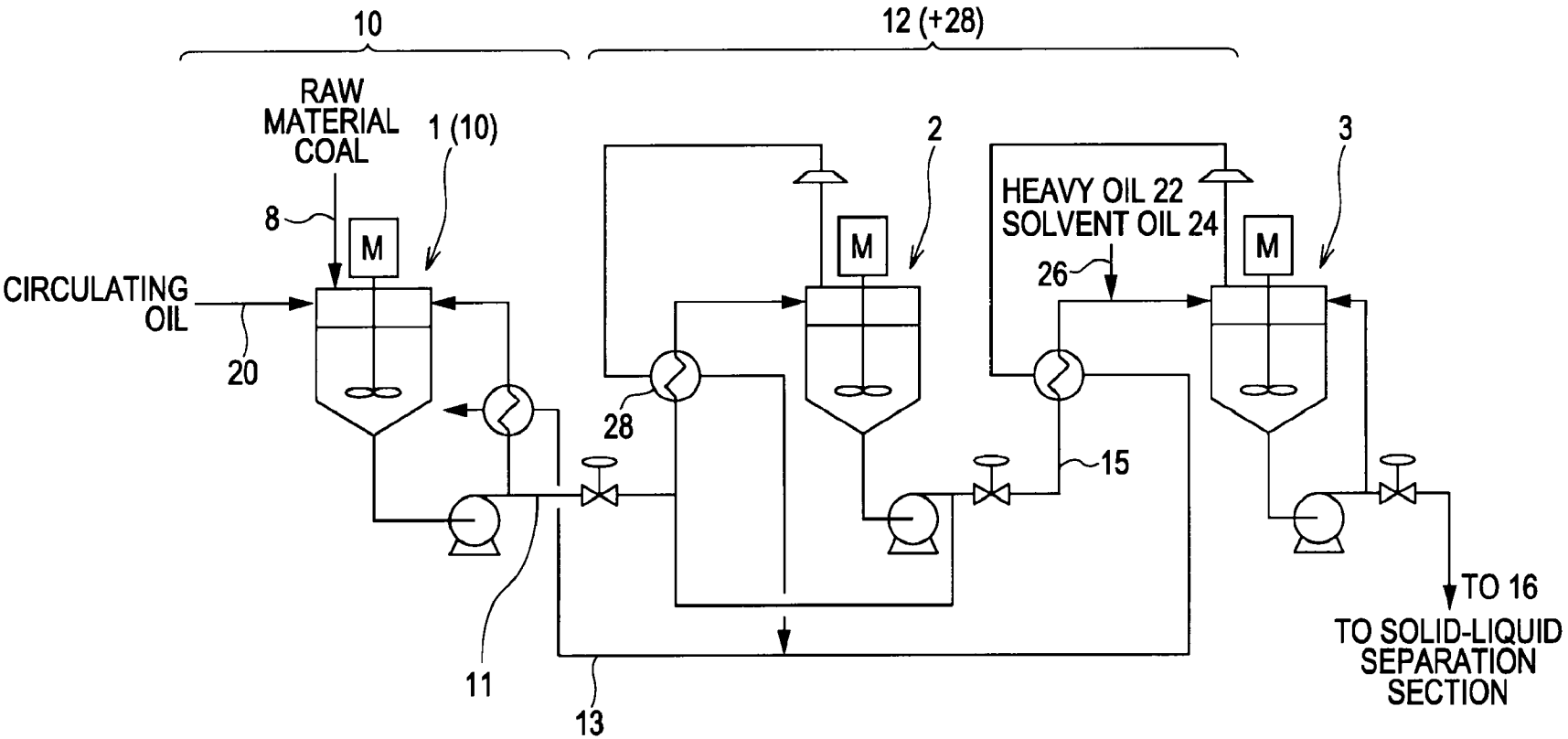
FIG. 5 is a schematic representation of a mixing section and an evaporating section in the solid fuel production process of Example 1.

A flow diagram of the solid fuel production process of Example 1 is shown in FIG. 2. FIG. 5 shows the raw material slurry preparation section (mixing section 10) and the moisture evaporation section (evaporating section 12) of this production process in detail (including a preheating section 28).

As shown in FIGS. 2 and 5, a raw material coal (low rank coal) 8 was pulverized in a pulverizing section 14 and then fed into a raw material slurry preparation section (mixing section 10), or the mixing vessel 1. The raw material coal was mixed with an oil (containing a solvent oil) in the mixing vessel 1 to prepare a raw material slurry 11. The raw material coal 8 shown in FIG. 5 has been already pulverized in the pulverizing section 14. The low rank coal used as the raw material coal 8 was the same Samarangau coal as in Comparative Example 1. As the oil (equivalent to the "oil containing a solvent oil" in the invention) that was to be mixed with the low rank coal, a solvent oil (kerosene) was used at the beginning of the operation, and a circulating oil 20 was used in the subsequent stages in such a manner that oil component discharged from the solid-liquid separation section (mechanical separation) 16 and/or the final drying section (separation by evaporation) 18 was circulated as a circulating oil 20 to the mixing vessel 1 (or the mixing section 10).

The raw material slurry was preheated in the preheating section 28. Then, moisture was evaporated from the slurry in the evaporating section 12 (a first evaporator 2 and a second evaporator 3), and a mixture (hereinafter referred to as the heavy oil-containing oil mixture) 26 containing a heavy oil 22 and a solvent oil (kerosene) 24 was added to the slurry 15 in the course of the moisture evaporation. More specifically, after the moisture evaporation in the first evaporator 2, the heavy oil-containing oil mixture 26 was added to the slurry 15 after the moisture evaporation, and the second evaporator 3 evaporated moisture from the slurry after the addition of the heavy oil-containing oil mixture. In this process, asphalt was used as the heavy oil.

In this instance, the amount of added heavy oil (asphalt) was set so that 0.3% by mass of heavy oil would be deposited in the later-described solid fuel (obtained by evaporating the oil component with a dryer from the cake prepared by solid-liquid separation) relative to the dried low rank coal (reformed coal) in the solid fuel. The amount of added heavy oil is smaller than that in Comparative Example 1 (the amount of added heavy oil set so that 0.5% by mass of heavy oil would be deposited in the solid fuel (obtained by evaporating the oil component with a dryer from the cake prepared by solid-liquid separation) relative to the dried porous coal (reformed coal) in the solid fuel), and a smaller amount of heavy oil (by 40%) is used than the heavy oil used in Comparative Example 1. More specifically, the amount of heavy oil used is reduced to 60% of the amount used in Comparative Example 1.

In the process, the evaporators 2 and 3 were the same as in Comparative Example 1, and the evaporators were heated to the same temperature as in Comparative Example 1.

The slurry subjected to moisture evaporation by the second evaporator 3 was delivered to the solid-liquid separation section (mechanical separation) 16 and was subjected to solid-liquid separation in a centrifuge. The solid component (cake) prepared by this separation was delivered to the final drying section (separation by evaporation) 18 and was heated to evaporate the oil component with a dryer while a carrier gas was flowing. Thus, a solid fuel was produced as in Comparative Example.

The liquid component (oil component) 38 separated in the centrifuge was circulated as a circulating oil 20 to the mixing vessel 1. The oil component 40 evaporated with the dryer (evaporated oil component) was liquefied in the same manner as in Comparative Example 1. The entirety of the liquefied oil component was circulated as the circulating oil 20 to the mixing vessel 1. The circulating oil 20 was used as the oil for preparing the raw material slurry (equivalent to the "oil containing a solvent oil" used in the present invention).

The solid fuel production process described above was continuously performed, consequently producing a low-pyrophoricity, transportable, storable dewatered solid fuel. The amount of heavy oil deposited in this solid fuel (obtained by evaporating the oil component with the dryer from the cake prepared by solid-liquid separation) was 0.3% by mass relative to the dried low rank coal (reformed coal) in the solid fuel. The amount of deposited heavy oil is smaller than that in Comparative Example 1. This means that the amount of heavy oil used can be reduced to a level lower than that in Comparative Example 1 (hence, the heavy oil can be reduced to 60% of that used in Comparative Example 1). As described above, Example 1 allows a smaller amount of heavy oil (by 40%) to be added than Comparative Example 1.

Thus, it has been confirmed that Example 1 can produce a low-pyrophoricity, transportable, storable, formable dewatered solid fuel even if a smaller amount of heavy oil is added than the amount used in Comparative Example 1. Hence, it has been confirmed that Example 1 allows a smaller amount of heavy oil to be added than the Comparative Example 1, and that the amount of heavy oil added, or used, can be reduced (by 40%).

Example 2

Figure 6:
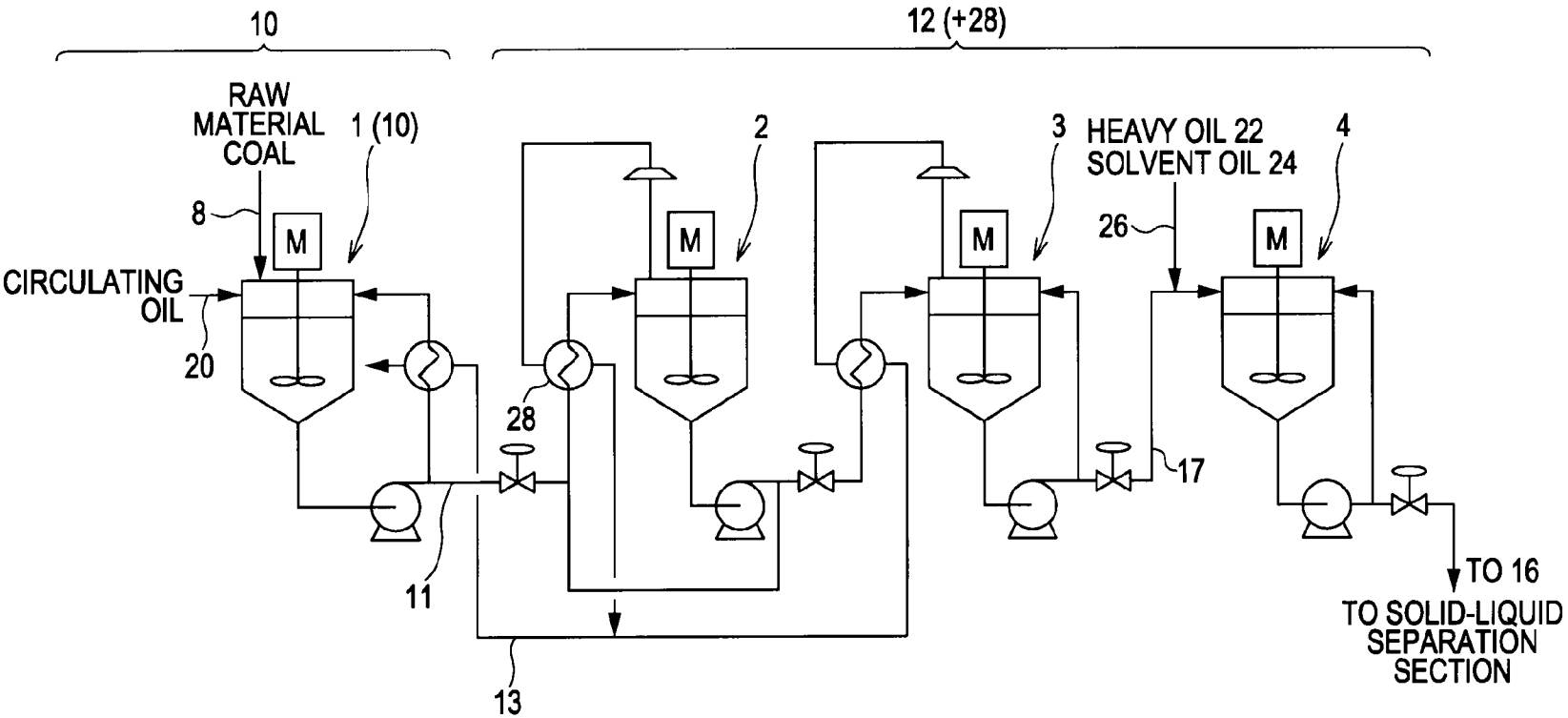
FIG. 6 is a schematic representation of a mixing section and an evaporating section in the solid fuel production process of Example 2.

FIG. 6 shows the raw material slurry preparation section (mixing section 10) and the moisture evaporation section (evaporating section 12) of the solid fuel production process of Example 2 in detail.

As shown in FIG. 6, a low rank coal (pulverized) was fed as the raw material into the mixing vessel 1 and mixed with an oil (containing a solvent oil) in the mixing vessel 1 to prepare a raw material slurry 11. The low rank coal used as the raw material was the same Samarangau coal as in Comparative Example 1. As the oil (equivalent to the "oil containing a solvent oil" in the invention) that was to be mixed with the low rank coal, a solvent oil (kerosene) was used at the beginning of the operation, and a circulating oil 20 was used in the subsequent stages, as in Comparative Example 1.

The raw material slurry was preheated. Then, moisture was evaporated from the slurry in the evaporating section (a first evaporator 2, a second evaporator 3, and a third evaporator 4), and a heavy oil-containing oil mixture 26 (oil mixture containing a heavy oil 22 and a solvent oil 24) was added to the slurry 17 in the course of moisture evaporation. More specifically, the first evaporator 2 evaporated moisture from the raw material slurry, the second evaporator 3 evaporated moisture from the slurry after the moisture evaporation in the first evaporator. The heavy oil-containing oil mixture 26 was added to the slurry 17 after the moisture evaporation in the second evaporator 3. The slurry to which the heavy oil had been added was subjected to moisture evaporation in the third evaporator 4. In this process, asphalt was used as the heavy oil.

In this instance, the amount of added heavy oil (asphalt) was set so that 0.3% by mass of heavy oil would be deposited in the later-described solid fuel (obtained by evaporating the oil component with a dryer from the cake prepared by solid-liquid separation) relative to the dried low rank coal (reformed coal) in the solid fuel. The amount of added heavy oil is smaller than that in Comparative Example 1 (the amount of added heavy oil set so that 0.5% by mass of heavy oil would be deposited in the solid fuel (obtained by evaporating the oil component with a dryer from the cake prepared by solid-liquid separation) relative to the dried porous coal (reformed coal) in the solid fuel), and a smaller amount of heavy oil (by 40%) is used than the heavy oil used in Comparative Example 1.

In the process, the evaporators were the same as in Comparative Example 1 (but used in three stages), and the evaporators were heated to the same temperature as in Comparative Example 1.

The slurry subjected to moisture evaporation in the third evaporator 4 was delivered to the solid-liquid separation section (mechanical separation) 16 and was subjected to solid-liquid separation in a centrifuge. The solid component (cake) prepared by this separation was delivered to the final drying section (separation by evaporation) 18 and was heated to evaporate the oil component with a dryer while a carrier gas was flowing. Thus, a solid fuel was produced as above.

The liquid component (oil component) 38 separated in the centrifuge was circulated as a circulating oil 20 to the mixing vessel 1. The oil component 40 evaporated with the dryer (evaporated oil component) was liquefied in the same manner as in Comparative Example 1. The entirety of the liquefied oil component was circulated as the circulating oil 20 to the mixing vessel 1. The circulating oil 20 was used as the oil for preparing the raw material slurry (equivalent to the "oil containing a solvent oil" used in the present invention).

The solid fuel production process described above was continuously performed, consequently producing a low-pyrophoricity, transportable, storable, formable dewatered solid fuel. The amount of heavy oil deposited in this solid fuel (obtained by evaporating the oil component with the dryer from the cake prepared by solid-liquid separation) was 0.3% by mass relative to the dried low rank coal (reformed coal) in the solid fuel. The amount of deposited heavy oil is smaller than that in Comparative Example 1. This means that the amount of heavy oil used can be reduced to a level lower than in Comparative Example 1 (hence, the heavy oil can be reduced to 60% of that used in Comparative Example 1). As described above, Example 2 allows a smaller amount of heavy oil (by 40%) to be added than Comparative Example 1.

Thus, it has been confirmed that Example 2 can produce a low-pyrophoricity, transportable, storable, formable dewatered solid fuel even if a smaller amount of heavy oil is added than the amount used in Comparative Example 1. Hence, it has been confirmed that Example 1 allows a smaller amount of heavy oil to be added than the Comparative Example 1, and that the amount of heavy oil added, or used, can be reduced (by 40%).

Figure 3:
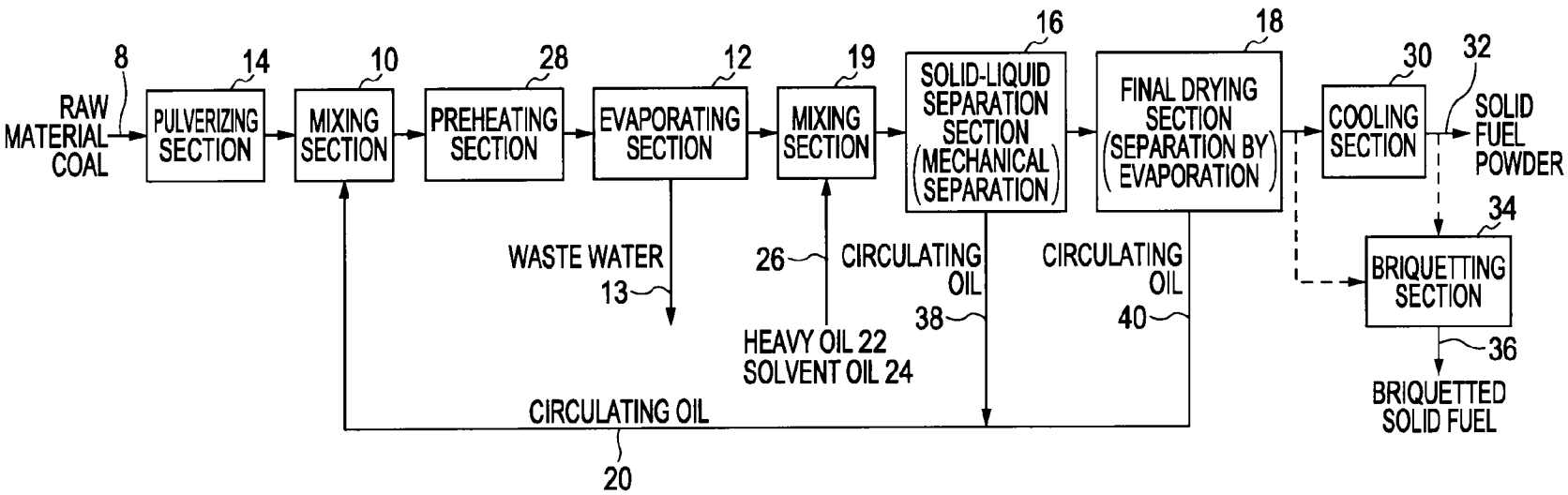
FIG. 3 is a flow diagram of a solid fuel production process according to another embodiment of the present invention.

In Examples 1 and 2, a heavy oil-containing oil mixture (oil mixture containing a heavy oil and a solvent oil) was added to the slurry in the course of moisture evaporation. If the heavy oil-containing oil mixture is added to the slurry after the completion of moisture evaporation, a process shown in, for example, FIG. 3 is performed. More specifically, while the slurry after the completion of moisture evaporation in the evaporating section is introduced to the mixing section 19, the heavy oil-containing oil mixture 26 is introduced to the mixing section 19 and mixed with the slurry. The slurry mixed with (containing) the heavy oil-containing oil mixture is subjected to solid-liquid separation in the solid-liquid separation section 16. The subsequent steps are performed in the same manner as in Examples 1 and 2.

INDUSTRIAL APPLICABILITY

The present invention can be suitably applied to processes for producing a low-pyrophoricity dewatered reformed coal from a low rank coal and for giving a high formability to the reformed coal, and is thus advantageous.

The invention claimed is:

1. A solid fuel production process comprising the steps of:

mixing an oil containing a solvent oil with a coal to prepare a raw material slurry, wherein neither the oil nor the solvent oil includes any heavy oil, wherein the heavy oil is an oil having a component that has substantially no vapor pressure at 400° C.;

evaporating moisture from the raw material slurry, wherein no heavy oil is added to the raw material slurry prior to the evaporation step;

subsequently performing solid-liquid separation on the slurry to yield a solid fuel; and adding a heavy oil to the solid fuel after the completion of or in the course of evaporating moisture.

2. The production process according to claim 1, wherein the coal is a low rank coal.

3. The production process according to claim 1, wherein the step of adding a heavy oil to the solid fuel, after the completion of or in the course of evaporating moisture, adds the heavy oil in an amount whereby 0.3% by mass of the heavy oil is present in the solid fuel.

4. The production process according to claim 1, wherein the step of adding a heavy oil to the solid fuel is performed after the completion of the step of evaporating moisture.

* * * * *